US007712988B2

(12) United States Patent
Hattori

(10) Patent No.: US 7,712,988 B2
(45) Date of Patent: May 11, 2010

(54) SHEET FEED TRAY FOR IMAGE FORMING APPARATUS

(75) Inventor: Makoto Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 638 days.

(21) Appl. No.: 11/614,512

(22) Filed: Dec. 21, 2006

(65) Prior Publication Data

US 2007/0147940 A1 Jun. 28, 2007

(30) Foreign Application Priority Data

Dec. 26, 2005 (JP) ..... 2005-373236

(51) Int. Cl.
*B65H 1/04* (2006.01)
*B65H 1/26* (2006.01)
*B41J 13/10* (2006.01)

(52) U.S. Cl. ..... 400/624; 271/145; 271/164; 271/171; 399/393

(58) Field of Classification Search ..... 400/624–625, 400/692; 271/145, 162–164, 171; 399/393
See application file for complete search history.

(56) References Cited

U.S. PATENT DOCUMENTS 4,786,042 A * 11/1988 Stemmle ..... 271/9.1
5,333,852 A * 8/1994 Milillo et al. ..... 271/171
6,985,265 B2 * 1/2006 Ito ..... 358/400
7,284,754 B2 * 10/2007 Takahashi et al. ..... 271/171
2005/0133983 A1 * 6/2005 Jacobs et al. ..... 271/145
2006/0222434 A1 * 10/2006 Kitamura et al. ..... 400/624

FOREIGN PATENT DOCUMENTS

JP 1-209227 8/1989
JP 2001-088948 A 4/2001
JP 2008-162704 * 7/2008
JP 2008-105856 * 5/2009

OTHER PUBLICATIONS

JP Office Action dtd May 27, 2008, JP Appln. 2005-373236.

* cited by examiner

*Primary Examiner*—Daniel J Colilla
*Assistant Examiner*—Marissa L Ferguson-Samreth
(74) *Attorney, Agent, or Firm*—Banner & Witcoff, Ltd.

(57) ABSTRACT

A sheet feed tray including a regulating wall member being assembled in a displaceable manner with a placing tray, which includes a first tray side engagement portion, and regulating a position of a recording medium such that a wall portion of the regulating wall member contacts with the end portion of the recording medium, a first engagement member being disposed in the regulating wall member and including a first regulating wall member side engagement portion, the first regulating wall member engaging with the first tray side engagement portion regulates a displacement of the regulating wall member, an elastic unit being elastically deformable and generating a force for holding an engaging state between the first tray side engagement portion and the first regulating wall member side engagement portion, an elastic deformation regulating unit regulating a deformation amount of the elastic unit, and releasing operation unit releasing the engaging state.

9 Claims, 11 Drawing Sheets

IX-IX

LOCKED STATE

UNLOCKED STATE

SHEET FEED TRAY FOR IMAGE FORMING APPARATUS

CROSS-REFERENCE TO RELATED APPLICATION

This application claims priority from Japanese Patent Application No. 2005-373236, filed on Dec. 26, 2005, the entire subject matter of which is incorporated herein by reference.

TECHNICAL FIELD

Aspects of the present invention relate to a sheet feed tray for an image forming apparatus, which is suitably applicable to an electrophotographic image forming apparatus such as a laser printer.

BACKGROUND

A recording medium such as a recording sheet or OHP sheet is usually placed in a positioned state by contacting with a wall face such as an outer peripheral wall of a sheet feed tray for an image forming apparatus.

In a sheet feed tray capable of placing recording media of various sizes has a wall-shaped regulating wall member, which is made movable to contact with an end portion of the recording medium thereby to position it, and a lock mechanism for regulating a displacement of the regulating wall member (see, for example, JP-A-1-209227).

The lock mechanism disclosed in JP-A-1-209227 includes a saw-tooth shaped engaging portion (or a corrugated portion) formed in the sheet feed tray, an engagement pawl disposed at the regulating wall member for engaging with the engaging portion and a coil spring for pushing the engagement pawl onto the engaging portion. The engagement pawl is made movable relative to the engaging portion.

When the position of the regulating wall member is to be changed, the engagement pawl is displaced away from the engaging portion to release an engaging state (or a locked state) between the engaging portion and the engagement pawl, and the regulating wall member is moved while holding that released state. Then, the engagement pawl is brought into engagement with the engaging portion and fixes (or locks) the position of the regulating wall member.

SUMMARY

When an entire sheet feed tray is to be moved, the regulating wall member may impinge against another member or a printer, and an external force may act on the regulating wall member. The external force is received by a contacting face between the engagement pawl and the engaging portion. Thus, a force to release the engaging state (releasing force) may act on the engagement pawl.

JP-A-1-209227 discloses to push the engagement pawl onto the engaging portion by an elastic force of the coil spring so as to hold the engaging state between the engagement pawl and the engaging portion (this elastic force for holding the engaging state will be called "holding force"). If the external force acting on the regulating wall member is strong, the releasing force exceeds the holding force and the engaging state is released. In such a case, the regulating wall member may be moved unintentionally.

In view of the above, the holding force may be increased by enlarging a spring constant of the coil spring. When the position of the regulating wall member is to be changed, the engaging state has to be released by applying a force exceeding the holding force. If the holding force is increased, a strong force is needed when the position of the regulating wall member is to be changed. Thus, workability of the operation to change the regulating wall member is deteriorated.

Aspects of the invention prevent the regulating wall member from moving in case a strong external force acts on the regulating wall member while preventing the workability of the operation to change the position of the regulating wall member from being deteriorated.

DETAILED DESCRIPTION

General Overview

Figure 1:
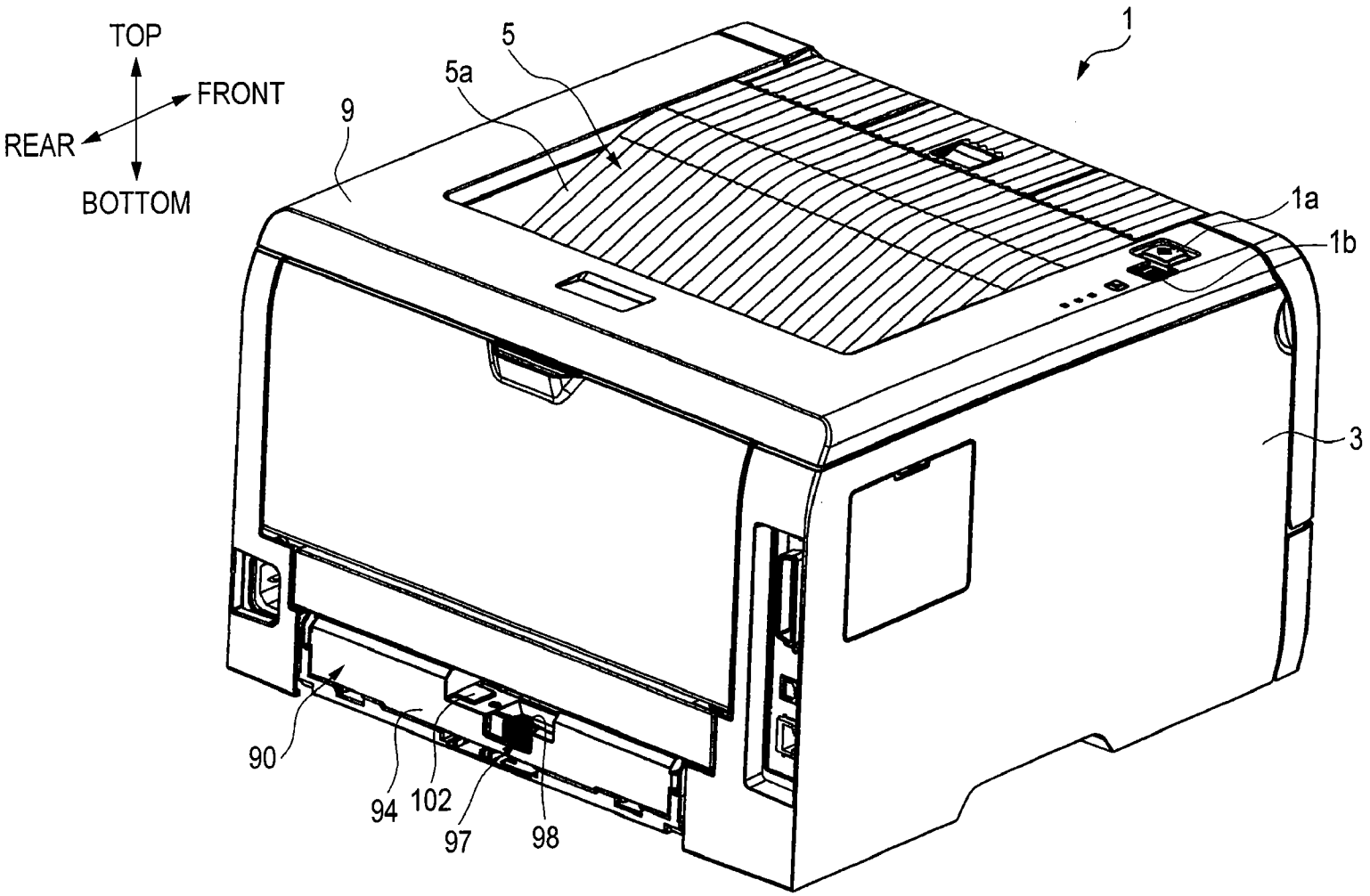
FIG. 1 is a perspective view showing the exterior of a laser printer according to an aspect of the invention.

According to a first aspect of the invention, there is provided a sheet feed tray for an image forming apparatus, comprising: a placing tray including a placing portion, on which a recording medium is placed, and a first tray side engagement portion; a regulating wall member which is assembled in a displaceable manner with the placing tray and regulates a position of the recording medium such that a wall portion of the regulating wall member contacts with an end portion of the recording medium; a first engagement member which is disposed on the regulating wall member and includes a first regulating wall member side engagement portion, the first regulating wall member engaging with the first tray side engagement portion and regulates a displacement of the regulating wall member; an elastic unit which is elastically deformable and generates a force for holding an engaging state between the first tray side engagement portion and the first regulating wall member side engagement portion; an elastic deformation regulating unit which regulates a deformation amount of the elastic unit; and a releasing operation unit which releases the engaging state between the first tray side engagement portion and the first regulating wall member side engagement portion.

When the position of the regulating wall member (94) is to be changed, a force exceeding the holding force has to act to release the engaging state. At the same time, the holding force is generated when the elastic unit is elastically deformed. Therefore, either in case the user releases the engaging state or in case a strong external force acts on the regulating wall member (94) to release the engaging state, the deformation of the elastic unit (96*d*) at the time when the engaging state is released is larger than that of the elastic unit (96*d*) at the time when the engaging state is held.

Thus, if the deformation of the elastic unit (96*d*) is regulated by the elastic deformation regulating unit (101), it is possible to prevent the elastic unit (96*d*) from being deformed to such an extent that the engaging state is released. Even if a strong external force acts on the regulating wall member (94), it is possible to prevent the engaging state from being released.

That is, according to the aspect of the invention, even if the strong external force acts on the regulating wall member (94), the engaging state can be prevented from being released without enlarging the spring constant of the elastic unit (96*d*) to increase the holding force.

Therefore, even if the strong external force acts on the regulating wall member (94), the regulating wall member (94) can be prevented from moving without deteriorating the workability of the position changing operation of the regulating wall member (94).

According to a second aspect of the invention, the sheet feed tray further comprising a second engagement member which is disposed on the regulating wall member and includes a second regulating wall member side engagement portion, the second regulating wall member engaging with a second tray side engagement portion disposed on the placing tray, wherein an elastic deformation portion which is elastically deformable and constitutes the elastic unit is provided in at least a part of the second engagement member, wherein the second regulating wall member side engagement portion is pushed onto the second tray side engagement portion by a reaction force of an elastic force of the elastic unit in pushing the first regulating wall member side engagement portion to the first tray side engagement portion, and wherein, when the releasing operation unit is operated, the first regulating wall member side engagement portion is displaced in a direction to increase the deformation of the elastic unit and releases the engaging state between the first tray side engagement portion and the first regulating wall member side engagement portion.

At this time, the second regulating wall member side engagement portion (96*b*) is pushed onto the second tray side engagement portion (91*b*) by the reaction force of the elastic force for the elastic unit (96*d*) to push the first regulating wall member side engagement portion (96*a*) onto the first tray side engagement portion (91*a*). Therefore, even if the engaging state between the first regulating wall member side engagement portion (96*a*) and the first tray side engagement portion (91*a*) is released so as to change the position of the regulating wall member (94), only the force for holding the engaging state between the second regulating wall member side engagement portion (96*b*) and the second tray side engagement portion (91*b*) (that is, the elastic force generated in the elastic unit (96*d*)) is increased. However, the engaging state between the second regulating wall member side engagement portion (96*b*) and the second tray side engagement portion (91*b*) is not released.

Therefore, if the second ray side engagement portion (91*b*) is disposed at a position corresponding to a standard size such as A4 or A5 determined by the Japanese Industrial Standards (JIS) or the like, tactile sensation can be given to the user when the regulating wall member (94) is positioned at the position corresponding to the standard size. As a result, the regulating wall member (94) can be easily displaced to a desired position without confirming the position of the regulating wall member (94) with graduations.

According to a third aspect of the invention, the sheet feed tray further comprising an elastic deformation regulating operation unit which is disposed on an upper face side of the regulating wall member and operates the elastic deformation regulating unit.

As a result, the elastic deformation regulating operation unit (102) can be operated from the upper face side of the regulating wall member (94). Accordingly, an operability of the elastic operation unit (102) can be improved.

According to a fourth aspect of the invention, the regulating wall member includes a recess portion which is recessed from the upper face side toward the lower end side thereof, and the releasing operation unit and the elastic deformation regulating operation unit are formed on the bottom portion of the recess portion.

As a result, the releasing operation unit (97) and the elastic deformation regulating operation unit (102) can be prevented from protruding from the upper face (or the upper end face) of the regulating wall member (94). It is also possible to prevent the image forming apparatus having the sheet feed tray of the invention from being large-sized.

According to a fifth aspect of the invention, the sheet feed tray further comprising a moving portion which is movable integrally with the elastic deformation regulating operation unit, wherein one of the moving portion and the regulating wall member includes an engagement projection which engages with an engagement recess portion formed on another one of the moving portion and the regulating wall member.

As a result, when the elastic deformation regulating operation unit (102) is operated, the engagement recess (94*d*) and the engagement projection (103*a*) engage with each other so that they can give tactile sensation to the user. Therefore, the user can be easily notified whether or not the engaging state between the first regulating wall member side engagement portion (96*a*) and the first tray side engagement portion (91*a*) is locked (or held). Accordingly, the operability of the elastic deformation regulating operation unit (102) can be improved.

According to a sixth aspect of the invention, the sheet feed tray further comprising: an arm-shaped member which is extended from a rotation center set in the regulating wall member and constitutes the first engagement member, the first regulating wall member side engagement portion being provided at a leading end side thereof; a leaf spring member which is extended from the first engagement member and constitutes the elastic member, the second regulating wall member side engagement portion being provided at a leading end side thereof; and an operation arm portion which is extended from the rotation center in a direction to intersect a longitudinal direction of the first engagement member and is rotatable integrally with the first engagement member, the releasing operation unit being disposed at a leading end side thereof.

According to a seventh aspect of the invention, the elastic deformation regulating unit regulates the rotation of the first engagement member and regulates the deformation of the elastic unit.

According to an eighth aspect of the invention, the elastic deformation regulating unit includes a stopper which moves in association with the operation of the elastic deformation regulating operation unit, and the rotation of the first engagement member is regulated by contacting the first engagement member with the stopper.

According to a ninth aspect of the invention, the stopper is displaced substantially in parallel with the longitudinal direction of the first engagement member in association with the operation of the elastic deformation regulating operation unit.

According to a tenth aspect of the invention, the regulating wall member constitutes at least a part of an outer peripheral wall of the placing tray, and the regulating wall member is arranged on a rear end side of the placing portion. The aspect of the invention can be effectively applied to the sheet feed tray for the image forming apparatus, because it is highly probable that the regulating wall member (94) impinges directly against the wall or the like near the portion where the image forming apparatus is disposed.

Incidentally, the parenthesized reference numerals of the aforementioned individual means present only the corresponding relations to the specific means to be described in the aspect. However, the invention should not be limited to the specific means designated by the parenthesized numerals.

<Illustrative Aspects>

In an illustrative aspect, which will be described with reference to the accompanying drawings, a sheet feed tray for an image forming apparatus is applied to an electrophotographic image forming apparatus (laser printer).

1. Exterior Structure of Laser Printer

FIG. 1 is a perspective view showing the exterior of a laser printer 1 according to the aspect of the invention taken from a rear side thereof. This laser printer 1 is disposed such that an upper side of the drawing is directed to an upper side of a direction of gravity. The laser printer 1 is usually used with a far side of the drawing being a front side.

A casing 3 of the laser printer 1 is formed into a substantially box shape (or a substantially stereoscopic shape) A discharge tray 5 for placing a recording medium, which is discharged from the casing 3 after being subjected to printing, is provided on an upper face side of the casing 3. The recording medium may be a sheet such as a paper sheet or OHP sheet.

The discharge tray 5 is configured to have a slope face 5*a* which slopes down from the upper face of the casing 3 toward the rear side. On the rear end side of the slope face 5*a*, there is formed a discharge port 7 (as referred to FIG. 2), from which the recording medium is discharged.

An upper cover 9 is so formed in a substantially C-shape as to enclose the discharge tray 5 (or the slope face 5*a*) of the casing 3. The upper cover 9 has a line switch 1*a* for switching the laser printer 1 to be connected with a network and to be disconnected from the network, and a job cancel switch 1*b* for ending (or interrupting) printing forcibly.

2. Internal Configuration of Laser Printer

Figure 2:
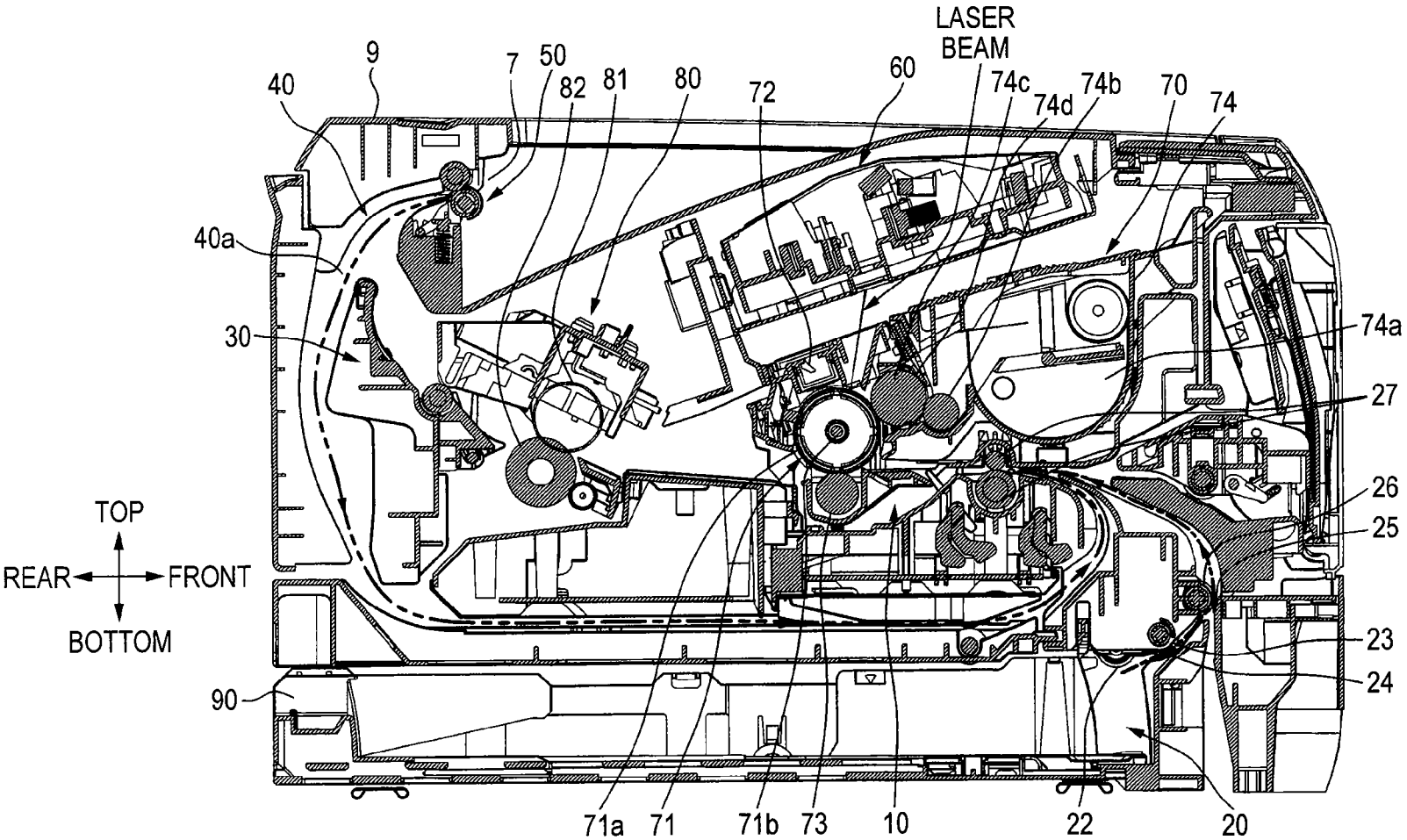
FIG. 2 is a sectional side view showing the laser printer.

FIG. 2 is a sectional side view of the laser printer 1. An image forming unit 10 forms an image on the recording medium. A feeder unit 20 constitutes a portion of a conveying unit for feeding the recording medium to the image forming unit 10.

A first discharge chute 30 and a second discharge chute 40 constitute a guide member for causing the recording medium having formed with the image at the image forming unit 10 to make a U-turn of about 180 degrees in a conveying direction thereof so as to guide the recording medium into the discharge port 7 that is formed above a fixing unit 80.

A forward/backward switching mechanism 50 constitutes a discharge roller reversing mechanism for reversing the conveying direction of the recording medium, which is conveyed from the image forming unit 10, and for conveying the recording medium reversed in the conveying direction toward the image forming unit 10. These devices 10, 20, 30, 40, 50 and so on are housed in the casing 3.

2.1 Image Forming Unit

The image forming unit 10 includes a scanner unit 60, a process cartridge 70 and a fixing unit 80.

2.1.1. Scanner Unit

The scanner unit 60 is disposed in the upper portion of the casing 3 for forming an electrostatic latent image on the surface of a photo sensitive drum 71. Specifically, this scanner unit 60 includes a laser light source, a polygon mirror, an fθ lens and reflecting mirrors.

The laser beam, which is emitted from the laser light source and based on image data, is deflected by the polygon mirror and passed through the fθ lens. The optical path is then folded back and bent downward by the reflecting mirror so that the surface of the photosensitive drum 71 is irradiated with the laser beam to form the electrostatic latent image.

2.1.2. Process Cartridge

The process cartridge 70 is removably arranged in the casing 3 on the lower side of the scanner unit 60. This process cartridge 70 includes the photosensitive drum 71, a charger 72, a transfer roller 73 and a developing cartridge 74.

The photosensitive drum 71 acts as an image carrying unit for carrying the image to be transferred to the recording medium. The photosensitive drum 71 includes a cylindrical drum body 71*a* and a drum shaft 71*b*. An outermost layer of the cylindrical drum body is made of a positively chargeable photosensitive layer such as polycarbonate. The drum shaft 71*b* extends axially and longitudinally in the drum body 71*a* for supporting the drum body 71*a* rotatably.

The charger 72 acts as a charging unit for charting the surface of the photosensitive drum 71. The charger 72 is so arranged obliquely above the rear side of the photosensitive drum 71 as to confront the photosensitive drum 71 across a predetermined spacing such that it does not contact with the photosensitive drum 71. The charger 72 may be a scorotron type charger for charging the surface of the photosensitive drum 71 substantially uniformly with a positive charge by making use of corona discharge.

The transfer roller 73 is arranged to confront the photosensitive drum 71 and to rotate in association with the photosensitive drum 71. This transfer roller 73 acts as a transfer unit for transferring the toner having adhered to the surface of the photosensitive drum 71 to a printing surface of the recording medium by causing a charge (i.e., negative charge), which is opposed to the charge at the photosensitive drum 71, to act on the recording medium from the side opposite to the printing face.

The developing cartridge 74 includes a toner housing chamber 74*a* housing the toner, a toner feed roller 74*b* for feeding the toner to the photosensitive drum 71 and a developing roller 74*c*.

The toner, which is housed in the toner housing chamber 74*a*, is fed toward the developing roller 74*c* by the rotation of the toner feed roller 74*b*. The toner, which is fed toward the developing roller 74*c*, is carried on the surface of the developing roller 74*c*. After regulated to a predetermined constant (or uniform) thickness, the toner is fed to the surface of the photosensitive drum 71, which is exposed to light by the scanner unit 70.

2.1.3. Fixing Unit

The fixing unit 80 is arranged on the down stream side of the photosensitive drum 71 in the conveying direction of the recording medium. The fixing unit 80 fixes the toner, transferred to the recording medium, by heating and melting it. Specifically, the fixing unit 80 includes a heating roller 81, which is arranged on the printing face side of the recording medium for heating the toner, and a pressure roller 82, which is arranged on the opposite side of the heating roller 81 across the recording medium for pushing the recording medium toward the heating roller 81.

The heating roller 81 includes a metal tube, a surface of which is coated with a fluorine resin, and a halogen lamp disposed in the metal tube for heating. On the other hand, the pressure roller 82 is configured by coating a metallic roller shaft coated with a roller made of a rubber material.

In the above-described image forming unit 10, an image is formed on the recording medium in the following manner.

Specifically, the photosensitive drum 71 is uniformly and positively charged by the charger 72, as it rotates, and is exposed to the laser beam, which is irradiated from and scanned at a high speed by the scanner unit 70. As a result, the electrostatic latent image corresponding to the image to be formed on the recording medium is formed on the surface of the photosensitive drum 71.

When the toner, which is carried on the developing roller 74*c* and positively charged, is brought to face and contact with the photosensitive drum 71 by the rotation of the developing roller 74*c*, the toner is fed to the electrostatic latent image formed on the surface of the photosensitive drum 71, namely, to such an exposed portion in the uniformly positively charged surface of the photosensitive drum 71 as has been exposed to the laser beam to lower its potential. As a result, the toner image by the reversal phenomenon is carried on the surface of the photosensitive drum 71.

The toner image carried on the surface of the photosensitive drum 71 is transferred to the recording medium by the transfer bias applied to the transfer roller 73. Then, the recording medium having the toner image transferred is conveyed to and heated by the fixing unit 80 so that the toner transferred as the toner image is fixed on the recording medium. Accordingly, the image formation is completed.

2.2. First Discharge Chute 30 and Second Discharge Chute 40

The first discharge chute 30 is a guide unit, which is arranged downstream of the fixing unit 80 in the conveying direction of the recording medium as shown in FIG. 2 and turns the conveying direction of the recording medium formed with an image at the image forming unit 10 by about 90 degrees and guides the recording medium to the second discharge chute 40.

The second discharge chute 40 is a guide unit, which is arranged on the upper cover 9 while having a predetermined clearance 40*a* from the first discharge chute 30 and which turns the recording medium turned by about 90 degrees in the conveying direction by the first discharge chute 30 further by about 90 degrees and guides the recording medium to the discharge port 7.

The clearance 40*a* between the first discharge chute 30 and the second discharge chute 40 forms part of a conveying passage (i.e., a conveying path indicated by a thick double-dotted line), in which the conveying direction is reversed by the forward/backward switching mechanism 50. In FIG. 2, a conveying path, which is indicated by a thick single-dotted line, indicates the conveying passage of the recording medium to be conveyed by the feeder unit 20.

2.3. Feeder Unit

The feeder unit 20 includes a sheet feed tray 90 housed in the lowest position of the casing 3, a sheet feed roller 22 disposed in a printer body portion above the front end portion of the sheet feed tray 90 for conveying the recording medium to the image forming unit 10, and a separating roller 23 and a separating pad 24 for separating the recording medium being conveyed by the sheet feed roller 22 one at a time. The recording medium, which is placed on the sheet feed tray 90, is caused to make a U-turn on the front side in the casing 3 and is conveyed to the image forming unit 10 arranged at a substantially central portion in the casing 3.

In the conveying path of the recording medium from the sheet feed tray 90 to the image forming unit 10, a paper dust removing roller 25 for removing paper dust or the like having stuck to image forming face (or the printing face) of the recording medium is arranged on the outer side of a crest of the substantially U-turned portion. An opposed roller 26 for pushing the recording medium to be conveyed onto the paper dust removing roller 25 is arranged on the inner side of that crest.

At the entrance of the image forming unit 10 in the conveying path from the sheet feed tray 90 to the image forming unit 10, moreover, there is arranged a resister roller 27, which is composed of a pair of rollers for regulating the conveying state of the recording medium by applying a conveying resistance to the recording medium.

2.4. Sheet Feed Tray

Figure 3:
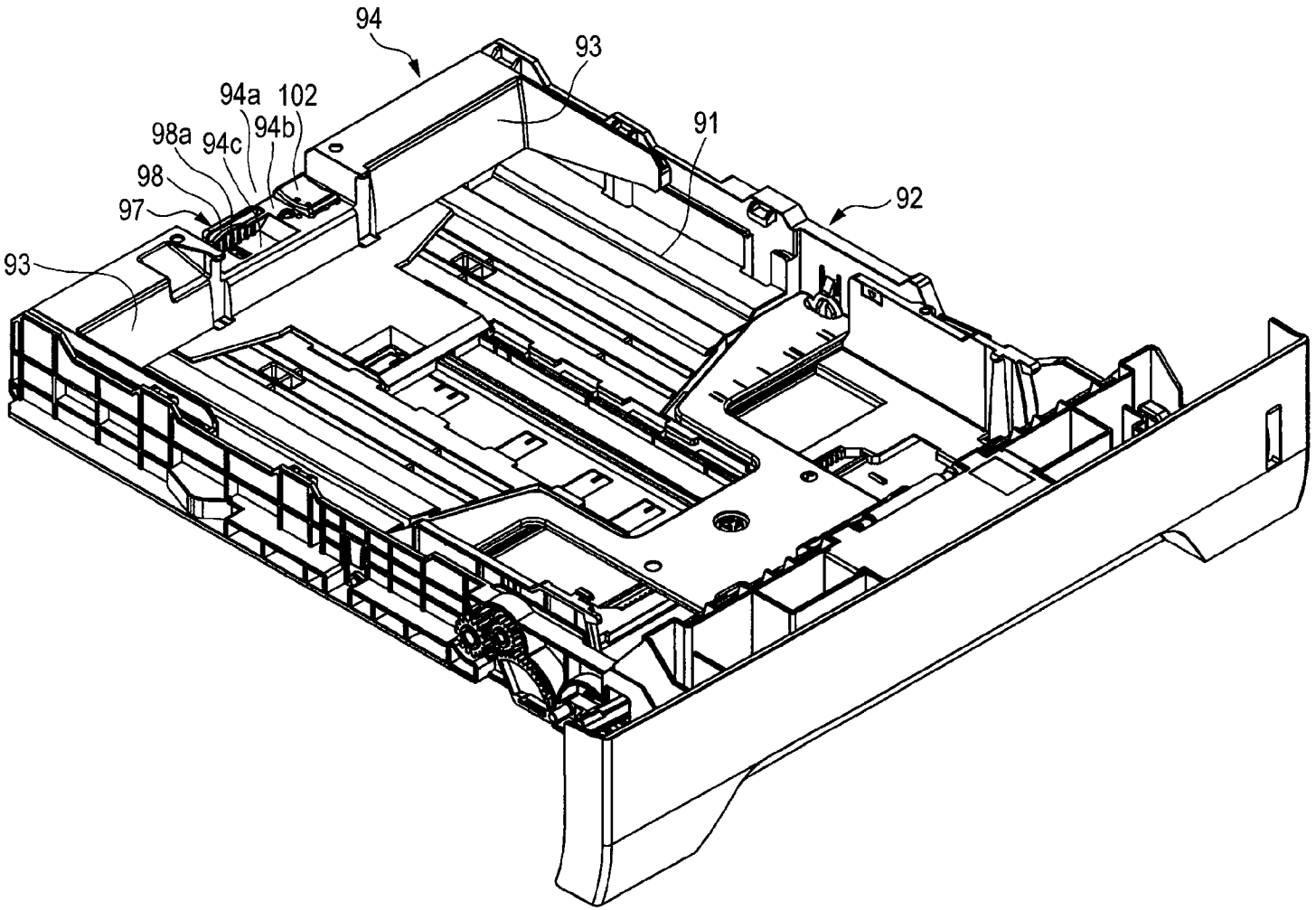
FIG. 3 is a perspective view of an upper face side of a sheet feed tray.
Figure 4:
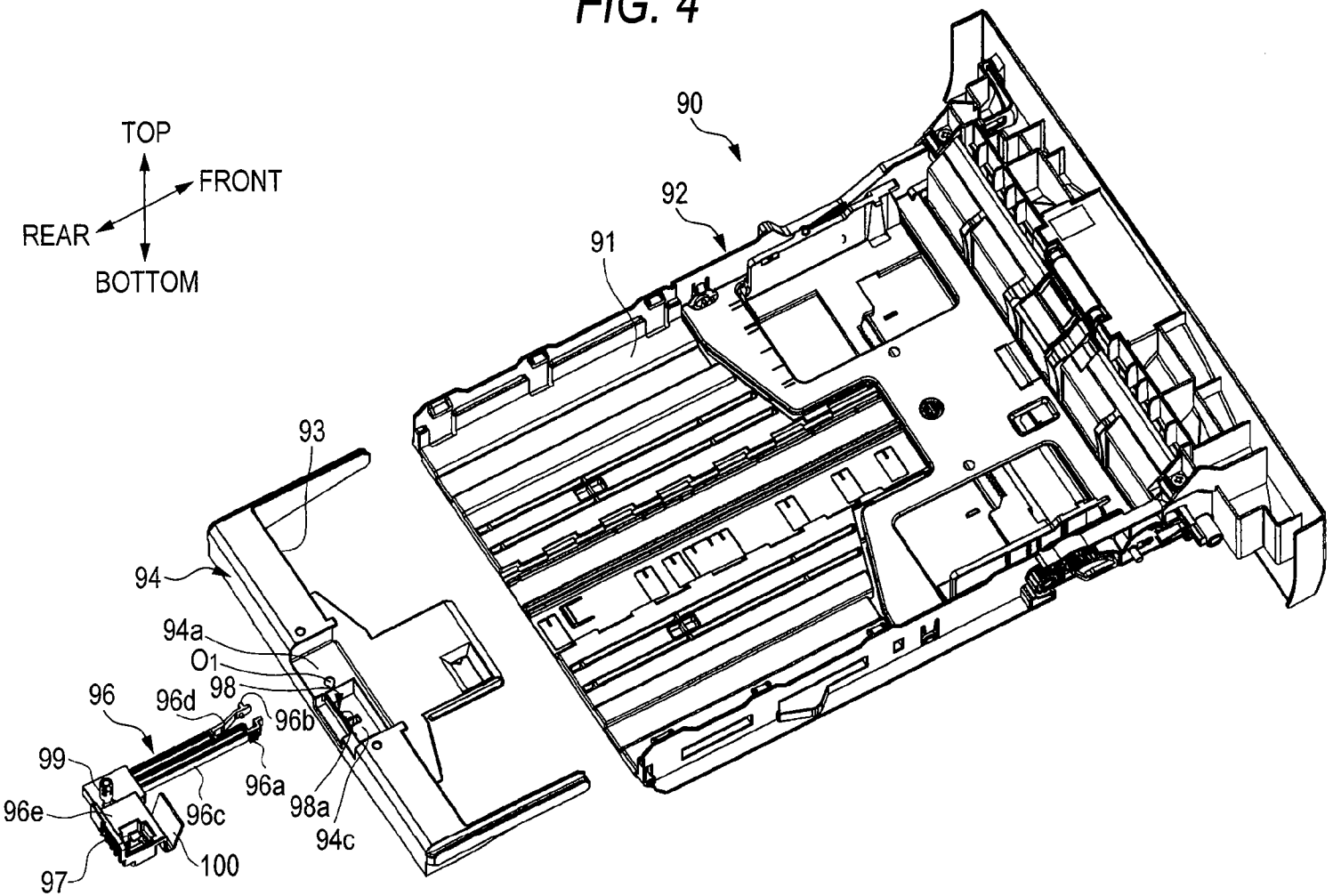
FIG. 4 is an exploded perspective view of the sheet feed tray.
Figure 5:
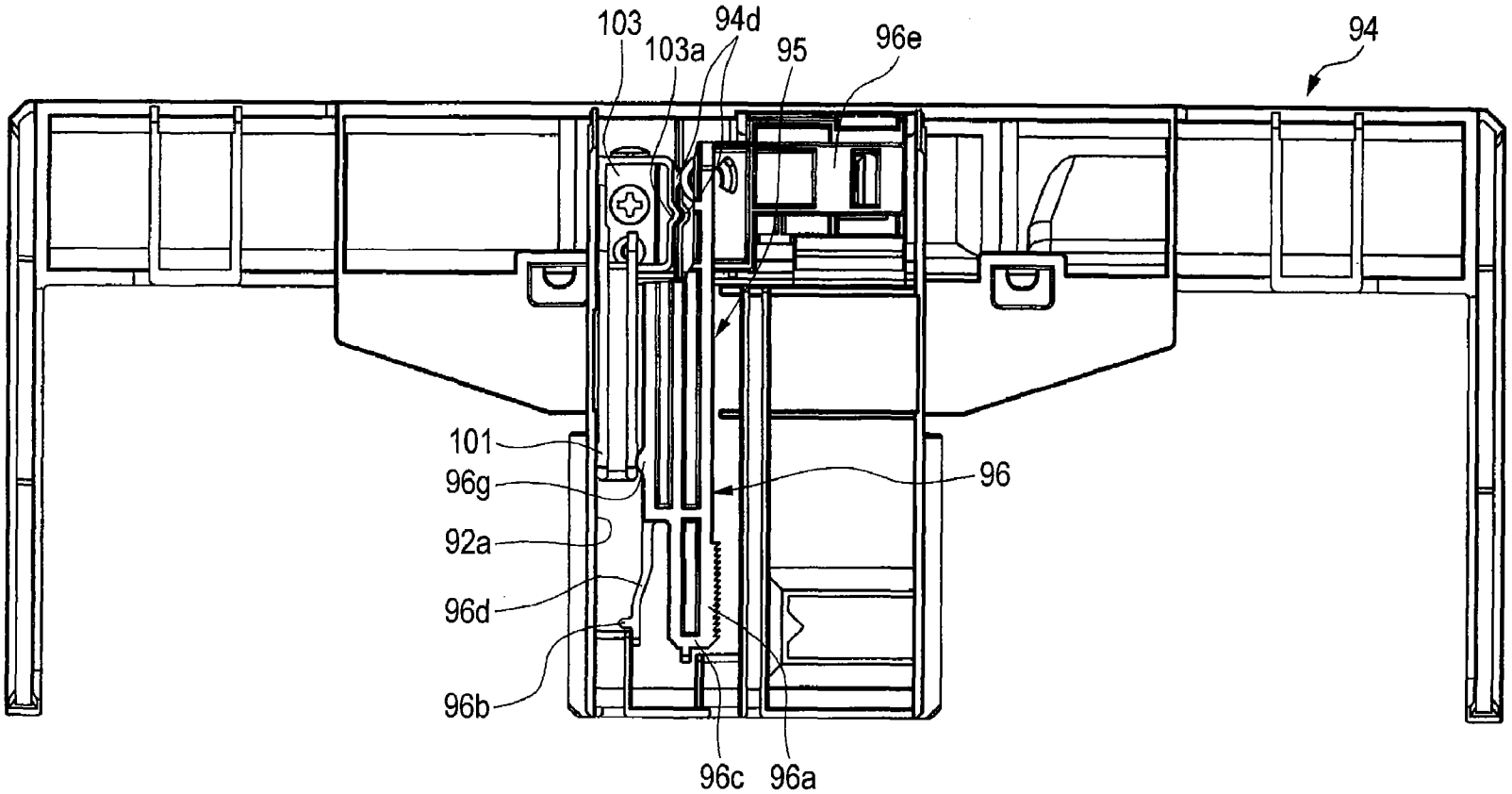
FIG. 5 is a lower face view of a regulating wall member.
Figure 6:
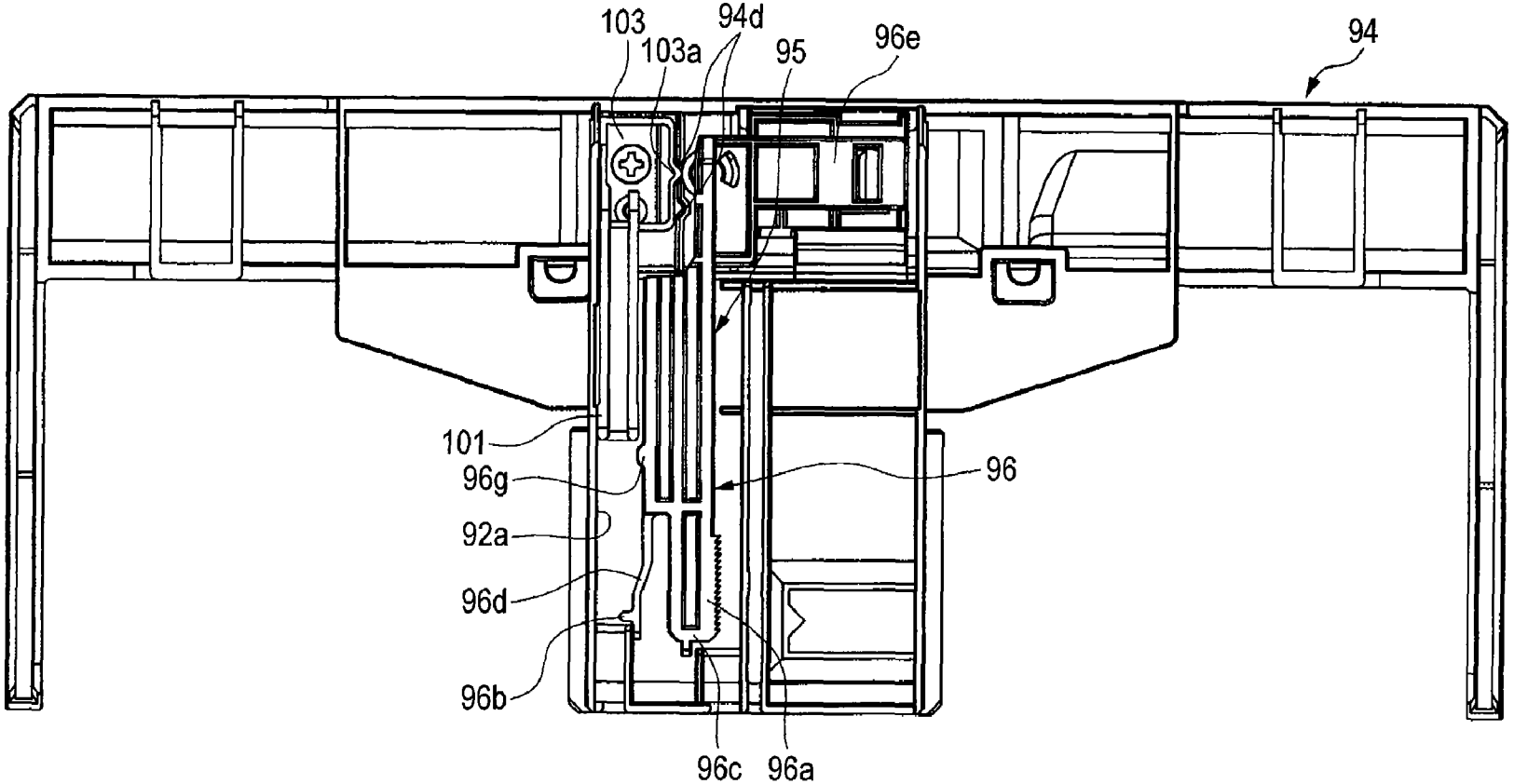
FIG. 6 is a lower face view of the regulating wall member.
Figure 7:
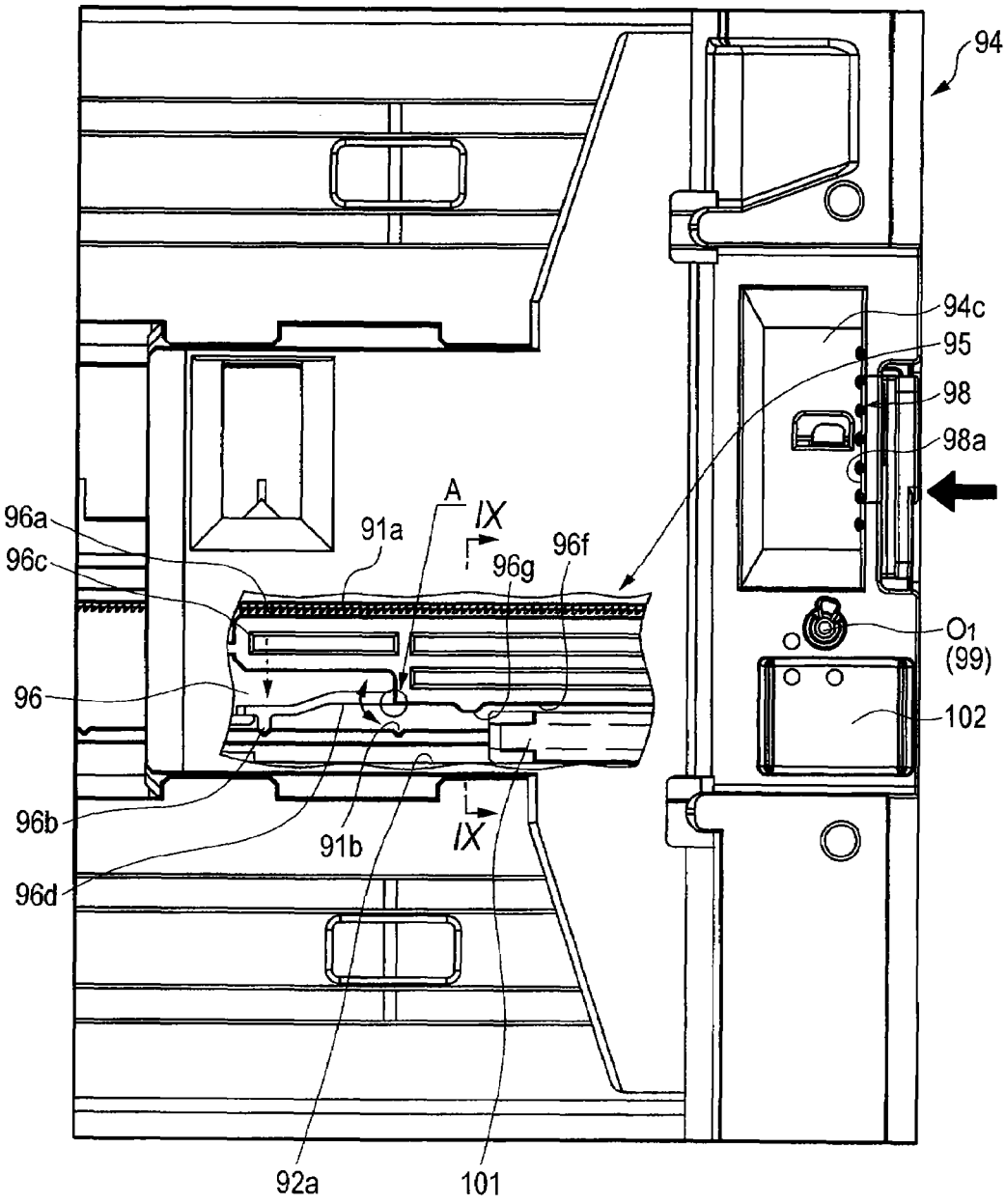
FIG. 7 is an enlarged view of a lock mechanism.
Figure 8:
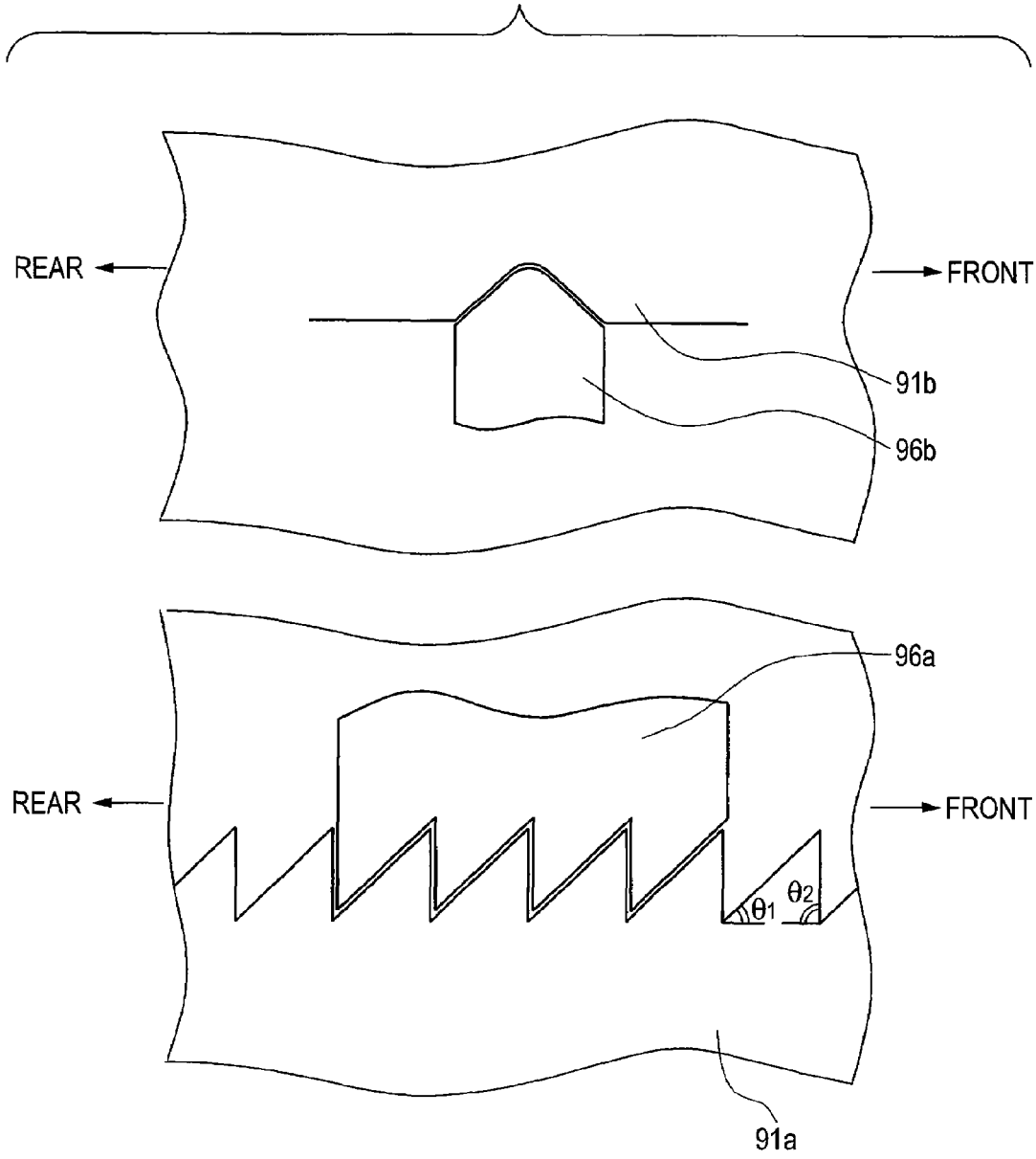
FIG. 8 is an enlarged view of the lock mechanism.
Figure 9:
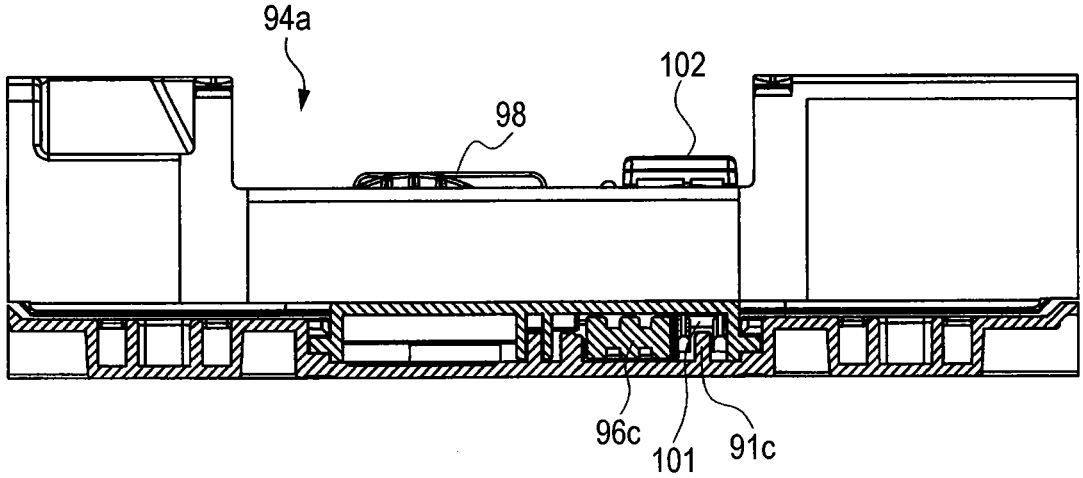
FIG. 9 is a sectional view taken along line IX-IX of FIG. 7.

FIG. 3 is a perspective view of the upper face side of the sheet feed tray 90. FIG. 4 is an exploded perspective view of the sheet feed tray 90. FIG. 5 and FIG. 6 are lower face views of a regulating wall member 94. FIG. 7 and FIG. 8 are enlarged views of a lock mechanism 95. FIG. 9 is a sectional view taken along line IX-IX of FIG. 7.

As shown in FIG. 3, the sheet feed tray 90 includes a placing tray 92 having a placing portion 91 for placing the recording medium and the regulating wall member 94 having a wall portion 93 for contacting with the end portion of the recording medium thereby to regulate the position of the recording medium.

The regulating wall member 94 is assembled with the rear end side of the placing tray 92 so that it may be displaced back and forth with respect to the placing tray 92. The regulating wall member 94 constitutes part of the outer peripheral wall of the placing tray 92 formed in a substantially rectangular shape. This displacement of the regulating wall member 94 is regulated by the lock mechanism 95 shown in FIG. 5 and FIG. 6.

As shown in FIG. 7, the lock mechanism 95 includes a first tray side engagement portion 91*a* and a second tray side engagement portion 91*b* disposed on the bottom portion (or the placing portion 91) of the placing tray 92 and an engagement member 96 assembled with the regulating wall member 94 and adapted to be moved integrally with the regulating wall member 94 with respect to the placing tray 92. The engagement member 96 includes a first regulating wall member engagement portion 96*a* for engaging with the first tray side engagement portion 91*a* and a second regulating wall member side engagement portion 96*b* for engaging with the second tray side engagement portion 91*b*.

The first tray side engagement portion 91*a* and the first regulating wall member side engagement portion 96*a* are formed into projections and depressions having saw-tooth shapes to mesh with each other, as shown in FIG. 8. The second regulating wall member side engagement portion 96*b* is formed into a projection having a shape of a substantially isosceles triangle. The second tray side engagement portion 91*b* are formed into such a recess as to fit the projection having the isosceles triangle shape of the second regulating wall member side engagement portion 96*b*.

In this aspect of the invention, of the projections and depressions of the saw-tooth shapes formed at the first tray side engagement portion 91*a*, a number of projections are formed into a substantially right-angled triangular shape such that the inclination angle θ1 of the rear side slopes is smaller than the inclination angle θ2 of the front side slopes and that the first tray side engagement portion 91*a* forms the saw-tooth shape. The second tray side engagement portion 91*b* is discretely formed such that the wall portion 93 is fixed at a position to correspond to the sheet size such as the standard size of A4 or A5 determined by the standards such as the JIS.

As shown in FIG. 4, the first regulating wall member side engagement portion 96*a* is formed on the leading end side of a first arm 96*c* extending from the rotation center O1 (or a pivot 99) set in the regulating wall member 94. The second regulating wall member engagement portion 96*b* is formed on the leading end side of a second arm 96*d* of a leaf spring extending from the first arm 96*c*.

A releasing operation unit 97 (which will be described later) is disposed at the leading end side of a third arm 96*e*, which extends from the rotation center O1 (or the pivot 99) in a direction substantially perpendicular to the longitudinal direction of the first arm 96*c* and which rotates integrally with the first arm 96*c*.

As shown in FIG. 3, on the opposite side of the placing portion 91 across the wall portion 93, there is arranged the releasing operation unit 97 for releasing the regulated state of the lock mechanism 95. On the side closer to the placing portion 91 than the releasing operation unit 97 and on the opposite side of the placing portion 91 across the wall portion 93, there is fixed and arranged on the regulating wall member 94 a pinch member 98 which has a pinch face 98*a* substantially normal to the operation direction (or forward and backward) of the releasing operation unit 97 and to the displacement direction (or forward and backward) of the regulating wall member 94.

The regulating wall member 94 has a first recess 94*a*, which is recessed from the upper end to the lower end side thereof. The releasing operation unit 97 and the pinch member 98 are disposed on the bottom portion 94*b* of the first recess 94*a*, and the upper end of the releasing operation unit 97 and the upper end of the pinch member 98 are substantially flush, when viewed horizontally, with the bottom portion 94*b* of the first recess 94*a*.

The bottom portion 94*b* of the first recess 94*a* is provided with a second recess 94*c*, which is recessed in a box shape in the lower end side of the regulating wall member 94. In this aspect, the pinch face 98*a* is formed by the side wall of the second recess 94*c* recessed in the substantially box shape.

The releasing operation unit 97 is operated back and forth on the sheet feed tray 90 by turning (or rocking) it slightly on the pivot 99 (as referred to FIG. 4), which is turnably assembled with the regulating wall member 94. In this aspect, the releasing operation unit 97, the pivot 99, a spring portion (as referred to FIG. 4) and the first to third arms 96*c* to 96*e* are integrally molded of a resin.

The spring portion 100 is a leaf spring, which contacts at its leading end side with the inner wall of the regulating wall member 94 and causes the elastic force for returning the releasing operation unit 97 to the original position to act on the releasing operation unit 97.

Moreover, the releasing operation unit 97 is disposed at a position displaced transversely (or in a horizontal direction) with respect to the pivot 99. The second arm 96*d* is given such a spring property which has a lower rigidity than that of the first arm 96*c* and is easily deformed. The first arm 96*c* and the second arm 96*d* are displaced (or rocked) around the pivot 99 in response to the displacement (or the rocking motion) of the operated releasing operation unit 97 around the pivot 99.

The first arm 96*c*, i.e., the first regulating wall member side engagement portion 96*a* is pushed toward the first tray side engagement portion 91*a* by the force, which is generated on the root side (or at a portion A shown in FIG. 7) when the second arm 96*d* of the leaf spring shape is elastically deformed in the direction of solid arrow in FIG. 7. This pushing action holds the engaging state between the first tray side engagement portion 91*a* and the first regulating wall member side engagement portion 96*a*.

On the other hand, a reaction force, which is generated on the root side (or at the portion A in FIG. 7), acts on the second regulating wall member side engagement portion 96*b*. Thus, the second regulating wall member side engagement portion 96*b* is pushed by the reaction force toward the second tray side engagement portion 91*b*. Accordingly, the engaging state between the second regulating wall member side engagement portion 96*b* and the second tray side engagement portion 91*b* can be kept.

When the releasing operation unit 97 is operated, the first arm 96*c* is rotationally displaced in the direction of a broken arrow in FIG. 7 and the engaging state between the first tray side engagement portion 91*a* and the first regulating wall member side engagement portion 96*a* is released. At this time, the first arm 96*c* is rotationally displaced to approach the second arm 96*d*, which is indicated by the broken arrow in FIG. 7. Thus, the elastic displacement amount of the second arm 96*d* increases according to the rotational displacement of the first arm 96*c*.

As a result, the force to arise on the root side (or at the portion A of FIG. 7) of the second arm 96*d* increases. Thus, the engaging state between the second regulating wall member side engagement portion 96*b* and the second tray side engagement portion 91*b* is held even if the engaging state between the first tray side engagement portion 91*a* and the first regulating wall member side engagement portion 96*a* is released.

A stopper 101 constitutes an elastic deformation regulating unit for regulating the elastic deformation of the second arm 96*d* by regulating the rotational displacement of the first arm 96*c*. The stopper 101 is arranged between the side face 96*f* of the first arm 96*c* on the side of the second tray side engagement portion 91*b* and a wall face 92*a* formed on the placing tray 92 and extending substantially in parallel with the side face 96*f*. The stopper 101 can move in parallel with the direction substantially parallel to the longitudinal direction of the first arm 96*c*.

A stopper operation unit 102 is an elastic deformation regulating operation unit for moving the stopper 101 in parallel. The stopper operation unit 102 is disposed on the upper face side of the regulating wall member 94 and on the bottom portion 94*b* of the first recess 94*a*, as shown in FIG. 3.

A moving portion 103, which can move integrally with the stopper 101, is disposed on the lower face side of the stopper operation unit 102, as shown in FIG. 5 and FIG. 6. On one of the moving portion 103 and the regulating wall member 94 the moving portion 103 in this aspect, there is formed an engagement projection 103*a*, which engages with an engagement recess 94*d* disposed on the other (the regulating wall member 94).

As shown in FIG. 9, the first arm 96*c* is formed into a sectional shape having substantially two H components juxtaposed to enhance the bending rigidity. As a result, the warping deformation of the first arm 96*c* is vanishingly small and is smaller than that of the second arm 96*d*.

The stopper 101 is formed into a substantially C-shaped (or substantially U-shaped) sectional shape having a longitudinally extending groove portion. A projection 91*c* having the second tray side engagement portion 91*b* is fitted in the groove portion.

3. Operations of Laser Printer (Sheet Feed Tray 90)

In this aspect of the invention, with the leading end side of the second arm 96*d* being elastically deformed and warped toward the first arm 96*c*, the first tray side engagement portion 91*a* and the second tray side engagement portion 91*b* engage with the first regulating wall member side engagement portion 96*a* and the second regulating wall member side engagement portion 96*b*, respectively. By at least the engagement (or mesh) between the first tray side engagement portion 91*a* and the first regulating wall member side engagement portion 96*a*, the displacement of the regulating wall member 94 relative to the placing tray 92 is regulated.

When the operating force, which is indicated by the solid arrow in FIG. 7, acts on the releasing operation unit 97, the releasing operation unit 97 is slightly turned (or rocked) leftward on the pivot 99 (or the rotation center O1). Thus, the engaging state between the first tray side engagement portion 91*a* and the first regulating wall member side engagement portion 96*a* is released, and the second arm 96*d* is deformed to increase its warping deformation.

When the operating force indicated by the black arrow in FIG. 7 is caused to act on the releasing operation unit 97 thereby to release the engaging state between the first tray side engagement portion 91*a* and the first regulating wall member side engagement portion 96*a*, the regulating wall member 94 can be displaced (or slid) back and forth with respect to the placing tray 92, while the second regulating wall member side engagement portion 96*b* being pushed to contact with the second tray side engagement portion 91*b*.

That is, when the operating force indicated by the black arrow in FIG. 7 is caused to act on the releasing operation unit 97, the engaging state between the first tray side engagement portion 91*a* and the first regulating wall member side engagement portion 96*a* is released, whereas the second arm 96*d* is forced to rotate leftward on the pivot 99. At the same time, the projection, which has a substantially isosceles triangle shape and is disposed at the leading end of the second tray side engagement portion 91*b*, is fitted in the recess forming the second regulating wall member side engagement portion 96*b*. Accordingly, the second arm 96*d* is warped while being forced to turn leftward to an extent corresponding to the operation (or displacement) of the releasing operation unit 97.

Therefore, even if the releasing operation unit 97 is operated to release the engaging state between the first tray side engagement portion 91*a* and the first regulating wall member side engagement portion 96*a*, the engaging state between the second tray side engagement portion 91*b* and the second regulating wall member side engagement portion 96*b* is not released.

However, as described hereinbefore, the projection forming the second tray side engagement portion 91*b* is formed into the substantially isosceles triangle shape, and the recess to form the second regulating wall member side engagement portion 96*b* is also formed into the isosceles triangle shape. When the forward/backward force acts on the first tray side engagement portion 91*a*, the projection constituting the second regulating wall member side engagement portion 96*b* is so displaced toward the first arm 96*c* as to ride on the slope face of the recess formed in the second regulating wall member side engagement portion 96*b*.

The second arm 96*d* has a relatively elastically deformable structure. Thus, if the regulating wall member 94 is displaced back and forth while the engaging state between the first tray side engagement portion 91*a* and the first regulating wall member side engagement portion 96*a* being released, the engaging state between the second tray side engagement portion 91*b* and the second regulating wall member side engagement portion 96*b* is easily released.

Accordingly, the engagement between the second tray side engagement portion 91*b* and the second regulating wall member side engagement portion 96*b* hardly exerts influences to regulate the displacement of the regulating wall member 94. Rather, by bringing the second tray side engagement portion 91*b* and the second regulating wall member side engagement portion 96*b* into engagement, a proper tactile sensation can be given to the user at a position corresponding to the standard size when the regulating wall member 94 is to be displaced. Thus, the regulating wall member 94 can be easily displaced to a desired position without confirming the position of the regulating wall member 94 with a scale or the like.

In this aspect of the invention, the first tray side engagement portion 91*a* is formed into the saw-tooth shape by forming a number of projections into such a substantially right-angled triangular shape as to have slopes on the rear side. When the external force from the rear side toward the front side acts on the engagement member 96 (or the first regulating wall member side engagement portion 96*a*), the projections formed on the first regulating wall member side engagement portion 96*a* are so displaced toward the second arm 96*d* as to rise on the slopes formed on the first tray side engagement portion 91*a*.

Although the first arm 96*c* is harder to elastically deform than the second arm 96*d*, the first arm 96*c* may be warped toward the second arm 96*d* thereby to displace the engaging state between the first tray side engagement portion 91*a* and the first regulating wall member side engagement portion 96*a* when a relatively strong force acts from the rear side toward the front side on the engagement member 96 (or the first regulating wall member side engagement portion 96*a*).

The first tray side engagement portion 91*a* is formed of the projections of such a substantially right-angled triangular shape as to have slopes on the rear side. Thus, even if the force acts from the front side toward the rear side on the engagement member 96 (or the first regulating wall member side engagement portion 96*a*), contrary to the above case, the force to displace the projections formed in the second regulating wall member engagement portion 96*b* toward the second arm 96*d* is weaker than that of the case, in which the external force acts from the rear side toward the front side on the regulating wall member 94.

Therefore, even if the external force from the front side toward the rear side acts on the engagement member 96 (or the first regulating wall member side engagement portion 96*a*), the engagement state between the first tray side engagement portion 91*a* and the first regulating wall member side engagement portion 96*a* is usually not released. Thus, the regulating wall member 94 is not displaced.

If the external force to act on the regulating wall member 94 is high, the releasing force may exceed the holding force to release the engaging state. In such a case, the regulating wall member 94 may move unintentionally.

Figure 10A:
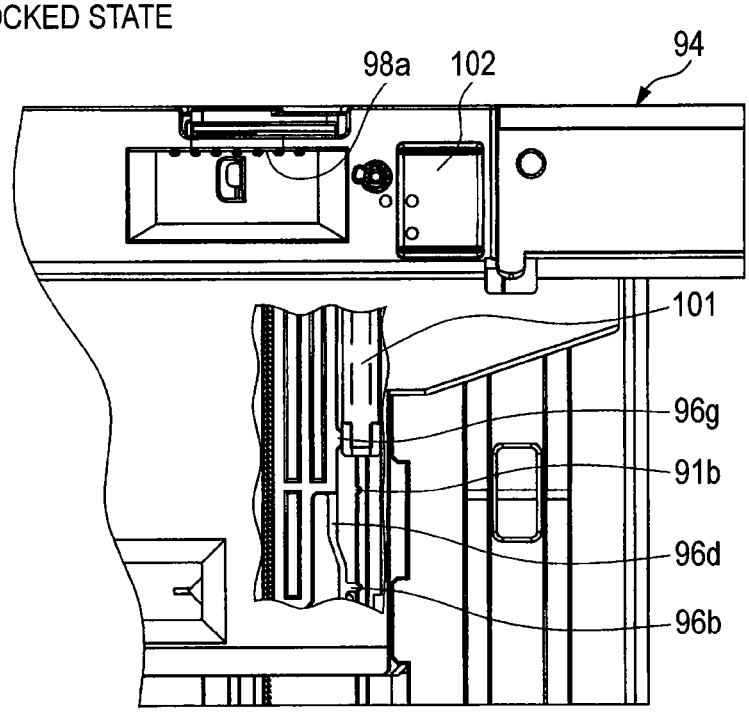
FIGS. 10A and 10B are views of the sheet feed tray taken from the upper side with a lock mechanism portion being broken.
Figure 11A:
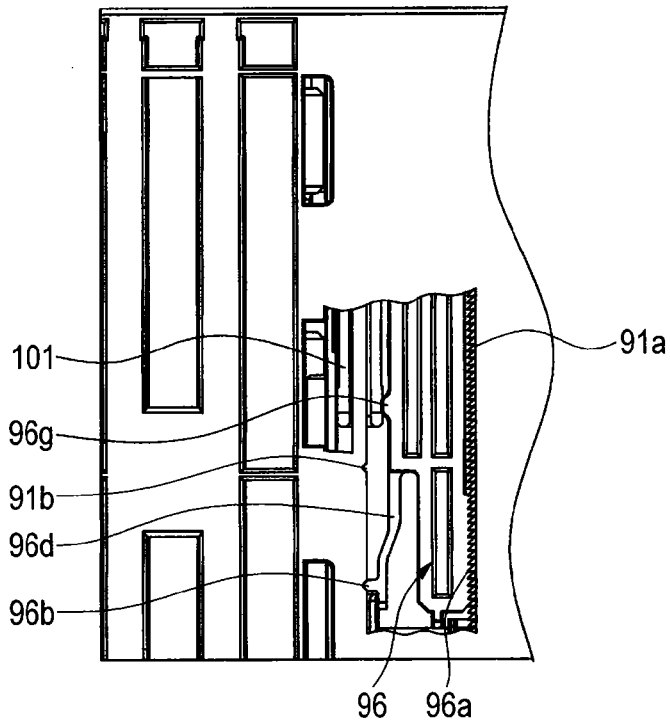
FIGS. 11A and 11B are views of the sheet feed tray taken from the lower side with the lock mechanism portion being broken.

However, in this aspect, the stopper operation unit 102 is operated to move the stopper 101 in parallel, as shown in FIG. 10A and FIG. 11A. Thus, the projection 96*g* projecting from the side face 96*f* of the first arm 96*c* toward the wall face 92*a* can be brought into contact with the stopper 101 thereby to prevent the first arm 96*c* from being rotationally displaced toward the second arm 96*d*. Therefore, it is possible to prevent the second arm 96*d* from being warped and deformed to an extent that the engaging state between the first regulating wall member side engagement portion 96*a* and the first tray side engagement portion 91*a* is released.

Figure 10B:
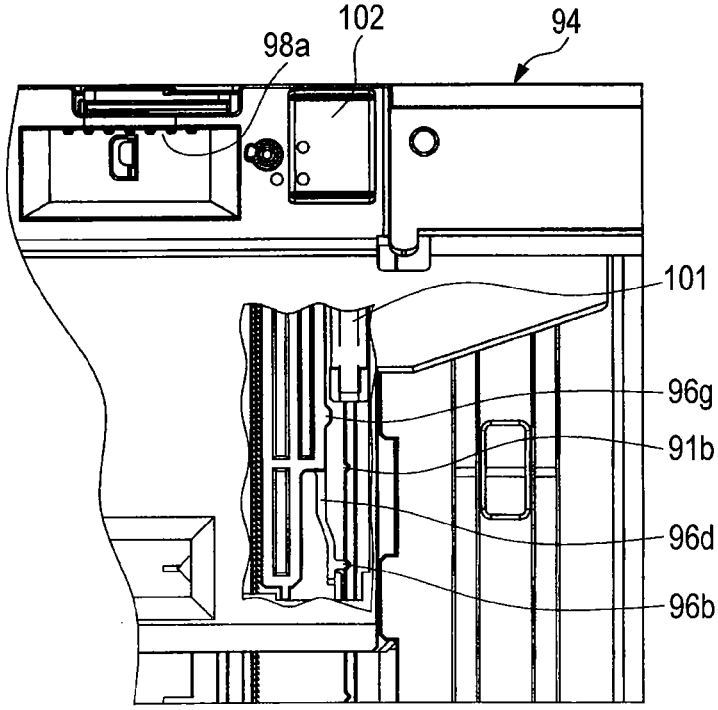
Figure 11B:
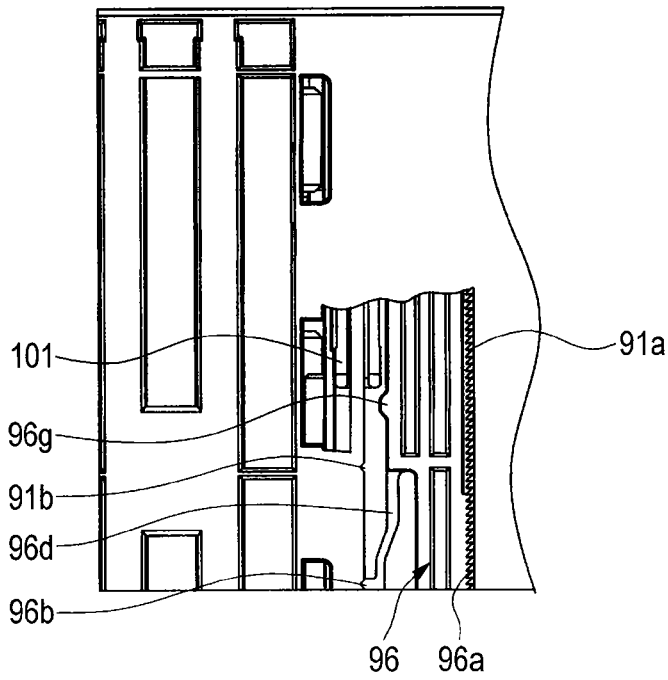

Incidentally, FIG. 10B and FIG. 11B are diagrams showing the state, in which the projection 96*g* and the stopper 101 are spaced to leave the first arm 96*c* and the second arm 96*d* unregulated.

Therefore, even if a strong external force acts on the regulating wall member 94, it is possible to prevent the engaging state from being released between the first regulating wall member side engagement portion 96*a* and the first tray side engagement portion 91*a*. Moreover, the engaging state can be prevented from being released without enlarging the holding force by increasing the spring constant of the second arm 96*d*.

Since the spring constant of the coil spring need not be enlarged to raise the holding force, the releasing operation unit 97 need not be operated (or pushed) by a strong operating force when the position of the regulating wall member 94 is to be changed. When a strong external force is applied to the regulating wall member 94, it is possible to prevent the regulating wall member 94 from moving while preventing the deterioration of the workability of the position changing operation.

In this aspect of the invention, the stopper operation unit 102 is disposed on the upper face side of the regulating wall member 94. Thus, the stopper operation unit 102 can be operated from the upper face side of the regulating wall member 94 thereby to improve the operability of the stopper operation unit 102.

The releasing operation unit 97 and the stopper operation unit 102 are disposed on the bottom portion of the first recess 94*a*. Thus, the releasing operation unit 97 and the stopper operation unit 102 can be prevented from protruding from the upper face (or the top end face) of the regulating wall member 94. Therefore, it is possible to prevent the vertical size of the regulating wall member 94 from being enlarged, thereby to prevent the sheet feed tray 90, i.e., the laser printer 1 from being large-sized.

Moreover, the moving portion 103 has the engagement projection 103*a*, and the regulating wall member 94 has the engagement recess 94*d* to engage with the engagement projection 103*a*. Therefore, the engagement recess 94*d* and the engagement projection 103*a* can engage with each other thereby to give the user tactile sensation when the stopper operation unit 102 is operated.

Therefore, the user can easily notice whether or not the engaging state between the first regulating wall member side engagement portion 96*a* and the first tray side engagement portion 91*a* has been locked (or held), as shown in FIG. 5 and FIG. 6. Accordingly, operability of the stopper operation unit 102 can be improved.

Incidentally, FIG. 5 shows the state, in which the engaging state between the first regulating wall member side engagement portion 96*a* and the first tray side engagement portion 91*a* is locked. FIG. 6 shows the state, in which the engaging state between the first regulating wall member side engagement portion 96*a* and the first tray side engagement portion 91*a* is released.

In the sheet feed tray 90, the regulating wall member 94 forms part of the outer peripheral wall of the placing tray 92, and the regulating wall member 94 is arranged on the rear end side of the placing portion 91, as shown in FIG. 4. Therefore, it is possible that the regulating wall member 94 directly impinges against the wall or the like near the portion where the laser printer 1 is arranged.

Therefore, it is especially effective that the sheet feed tray 90 is applied to the sheet feed tray of the laser printer 1, in which the regulating wall member 94 constitutes a portion of the outer peripheral wall of the placing tray 92 and is arranged on the rear end side of the placing portion 91.

Incidentally, the first arm 96*c* corresponds to a first engagement member. The second arm 96*d* corresponds to a second engagement member, an elastic unit and an elastic deformation portion. The stopper operation unit 102 corresponds to an elastic deformation regulating operation unit.

Moreover, the third arm 96*e* corresponds to an operation arm portion. The stopper 101 corresponds to an elastic deformation regulating unit. The stopper operation unit 102 corresponds to elastic deformation regulating operation unit.

(Other Aspects)

In the aforementioned aspect, the sheet feed tray is applied to the laser printer. However, the application of the invention should not be limited thereto but can also be applied an image forming apparatus such as a copying machine.

In the aforementioned aspect, the regulating wall member 94 forms part of the outer peripheral wall of the placing tray 92. However, the invention should not be limited thereto but can also be applied to a sheet feed tray, which is provided with the regulating wall member 94 separately of the outer peripheral wall of the placing tray 92.

In the aforementioned aspect, the bottom portion of the first recess 94*a* is provided with the releasing operation unit 97 and the pinch member 98, but the invention should not be limited thereto.

In the aforementioned aspect, the pinch face 98*a* is substantially normal to the displacing direction of the regulating wall member 94, but the invention should not be limited thereto.

Moreover, the lock mechanism 95 should not be limited to one in the aforementioned aspect. For example, the second regulating wall member side engagement portion 96*b* and the second tray side engagement portion 91*b* may be eliminated.

In the aforementioned aspect, the second arm 96*d* is formed into a leaf spring shape to constitute an elastic unit and an elastic deformation portion. However, the invention should not be limited thereto, but may apply an elastic unit such as a coil spring, a torsion spring or rubber.

In the aforementioned aspect, the engagement recess 94*d* and the engagement projection 103*a* is provided to establish tactile sensation when the stopper operation unit 102 is operated, but the invention should not be limited thereto.

In the aforementioned aspect, the elastic deformation of the second arm 96*d* (or the elastic unit) is regulated by regulating the rotation stroke of the first arm 96*c*. However, the invention should not be limited thereto, but the elastic deformation of the second arm 96*d* may also be directly regulated.

In the aforementioned aspect, the stopper 101 can be moved in a direction substantially parallel to the longitudinal direction of the first arm 96*c*, but the invention should not be limited thereto.

What is claimed is:

1. A sheet feed tray for an image forming apparatus, comprising:

a placing tray including a placing portion, on which a recording medium is placed, and a first tray side engagement portion;

a regulating wall member which is assembled in a displaceable manner with the placing tray and regulates a position of the recording medium such that a wall portion of the regulating wall member contacts with an end portion of the recording medium;

a first engagement member which is disposed on the regulating wall member and includes a first regulating wall member side engagement portion, the first regulating wall member side engagement portion engaging with the first tray side engagement portion and regulating displacement of the regulating wall member;

an elastic unit which is elastically deformable and generates a force for holding an engaging state between the first tray side engagement portion and the first regulating wall member side engagement portion;

an elastic deformation regulating unit which regulates a deformation amount of the elastic unit;

a releasing operation unit which releases the engaging state between the first tray side engagement portion and the first regulating wall member side engagement portion; and a second engagement member which is disposed on the regulating wall member and includes a second regulating wall member side engagement portion, the second regulating wall member side engagement portion engaging with a second tray side engagement portion disposed on the placing tray, wherein an elastic deformation portion which is elastically deformable and constitutes the elastic unit is provided in at least a part of the second engagement member, wherein the second regulating wall member side engagement portion is pushed onto the second tray side engagement portion by a reaction force of an elastic force of the elastic unit in pushing the first regulating wall member side engagement portion to the first tray side engagement portion, and wherein, when the releasing operation unit is operated, the first regulating wall member side engagement portion is displaced in a direction to increase the deformation of the elastic unit and releases the engaging state between the first tray side engagement portion and the first regulating wall member side engagement portion.

2. The sheet feed tray according to claim 1, further comprising an elastic deformation regulating operation unit which is disposed on an upper face side of the regulating wall member and operates the elastic deformation regulating unit.

3. The sheet feed tray according to claim 2, wherein the regulating wall member includes a recess portion which is recessed from the upper face side toward a lower end side thereof, and wherein the releasing operation unit and the elastic deformation regulating operation unit are formed on a bottom portion of the recess portion.

4. The sheet feed tray according to claim 2, further comprising a moving portion which is movable integrally with the elastic deformation regulating operation unit, wherein one of the moving portion and the regulating wall member includes an engagement projection which engages with an engagement recess portion formed on another one of the moving portion and the regulating wall member.

5. The sheet feed tray according to claim 4, further comprising:

an arm-shaped member which is extended from a rotation center set in the regulating wall member and constitutes the first engagement member, the first regulating wall member side engagement portion being provided at a leading end side thereof;

a leaf spring member which is extended from the first engagement member and constitutes the elastic member, the second regulating wall member side engagement portion being provided at a leading end side thereof; and an operation arm portion which is extended from the rotation center in a direction to intersect a longitudinal direction of the first engagement member and is rotatable integrally with the first engagement member, the releasing operation unit being disposed at a leading end side thereof.

6. The sheet feed tray according to claim 5, wherein the elastic deformation regulating unit regulates the rotation of the first engagement member and regulates the deformation of the elastic unit.

7. The sheet feed tray according to claim 6, wherein the elastic deformation regulating unit includes a stopper which moves in association with the operation of the elastic deformation regulating operation unit, and wherein the rotation of the first engagement member is regulated by contacting the first engagement member with the stopper.

8. The sheet feed tray according to claim 7, wherein the stopper is displaced substantially in parallel with the longitudinal direction of the first engagement member in association with the operation of the elastic deformation regulating operation unit.

9. The sheet feed tray according to claim 1, wherein the regulating wall member constitutes at least a part of an outer peripheral wall of the placing tray, and wherein the regulating wall member is arranged on a rear end side of the placing portion.

* * * * *